US010662713B2

(12) United States Patent
Liu et al.

(10) Patent No.: US 10,662,713 B2
(45) Date of Patent: May 26, 2020

(54) WATER CONSERVING REAMING SYSTEM

(71) Applicant: Zhijun Wang, Shenzhen (CN)

(72) Inventors: Xiaojun Liu, Shenzhen (CN); Caixia Wang, Shenzhen (CN); Junlong Liu, Shenzhen (CN)

(73) Assignee: Zhijun Wang, Shenzhen (CN)

( * ) Notice: Subject to any disclaimer, the term of this patent is extended or adjusted under 35 U.S.C. 154(b) by 0 days.

(21) Appl. No.: 16/178,603

(22) Filed: Nov. 2, 2018

(65) Prior Publication Data

US 2019/0242189 A1 Aug. 8, 2019

(30) Foreign Application Priority Data

Feb. 8, 2018 (CN) ..... 2018 1 0130588

(51) Int. Cl.

| | |
|---|---|
| ***E21B 7/18*** | (2006.01) |
| ***E21B 10/26*** | (2006.01) |
| ***E21B 17/00*** | (2006.01) |
| ***E21B 12/06*** | (2006.01) |

(52) U.S. Cl.

CPC ..... *E21B 7/18* (2013.01); *E21B 12/06* (2013.01)

(58) Field of Classification Search

CPC ..... E21B 10/26; E21B 17/006; E21B 19/24; E21B 7/28

See application file for complete search history.

(56) References Cited

U.S. PATENT DOCUMENTS 4,165,626 A * 8/1979 Pridy ..... B21C 37/30 29/81.02

FOREIGN PATENT DOCUMENTS

CN 203801418 U * 9/2014
CN 206952219 U * 2/2018

* cited by examiner

*Primary Examiner* — Zakiya W Bates

(57) ABSTRACT

A water conserving reaming system includes a water storage box, a water pumping pipe communicated with the water storage box, a first lifting platform, a second lifting platform, a reaming mechanism assembly, and a reamer bit connected with a front end of the reaming mechanism assembly. The first lifting platform includes a first base, a lifting frame arranged on an upper portion of the first base and a pipeline joint. An end of the water pumping pipe extends into the water storage box. An other end of the water pumping pipe is communicated with a bottom portion of the first base. A filtering mechanism for performing primary filtering treatment on a water source from the water pumping pipe is arranged inside the first base. The second lifting platform includes a second base and a telescopic column arranged on an upper portion of the second base.

5 Claims, 3 Drawing Sheets

WATER CONSERVING REAMING SYSTEM

BACKGROUND

1. Field

The present disclosure relates to the field of water conserving reaming system technology, and in particular to a water conserving reaming system with high sealing and high wear resistance, reasonable structural design, and good effect.

2. Description of Prior Art

Water pressure punching is required in the process of water reaming, and it is necessary to constantly replace drill bits In the beginning, low-pressure water is passed into holes that are drilled by a drill bit, and then high pressure water is passed through the holes for reaming. However a drill rod for passing the high pressure water is employed when reaming. Thus, two sets of device is required and the replacement is quite cumbersome. A high pressure water supply device is an important means of providing cooling water to the drill bit and the drill rod throughout the drilling process. Due to the particularity and complexity of the exploitation, in most cases, the temperature during mining is required to be cool, so the standard of cooling systems is strict. In order to supply cooling water to the drill rod, a high-pressure water supply is required. Since the drill rod is always rotating, the drill rod is required to be connected with the drill rod through a connecting joint to ensure the supply of cooling water without affecting rotation of the drill rod.

However, in conventional measures, a water supply port arranged in the joint, with a water outlets arranged in the drill rod may not be straight. When the high pressure water is supplied, it is easy to impact the seal of the joint, which causes water leakage at the seal, therefore, affecting sealing of the overfill system, causing a lowering of the water pressure at the drill hit, and affecting use. In order to cool and facilitate the drilling of the drill bit, it is necessary to pass through the high-pressure water, which is the cooling water with a pressure of 1 MPa to 40 MPa. The use of traditional drill rod often results in water leakage at the joint, which not only makes an insufficient amount of water reaching the drill bit, but also reduces the water pressure and affects the use. The conserving system of prior art is not intelligent enough and the level of automation is insufficient, thus, efficiency cannot be effectively improved.

Base on above problems, those skilled in the art carried out a lot of research and experiments and good results are obtained.

SUMMARY

In order to overcome the problems existing in the prior art, the present disclosure provides a water conserving reaming system with high-sealing and high-abrasion resistance, reasonable structural design and good effect.

Compared with the prior art, the present disclosure of the water conserving reaming system comprises a water storage box, a water pumping pipe communicated with the water storage box, a first lifting platform, a second lifting platform, a reaming mechanism assembly, and a reamer bit connected with a front end of the reaming mechanism assembly. The first lifting platform comprises a first base, a lifting frame arranged on an upper portion of the first base, and a pipeline joint. The reaming mechanism assembly is configured to perform the reaming operation, and the first lifting platform and the second lifting platform are capable of flexibly adjusting height, thereby achieving a good use effect. The water conserving reaming system of the present disclosure is highly intelligent and convenient to use.

DETAILED DESCRIPTION

To make the objects, technical proposals and merits of the present disclosure more apparent, the present disclosure will be further described in detail with reference to the drawings and embodiments. It should be understood that the embodiments described here are only used to illustrate the present disclosure and are not intended to limit the present disclosure.

Figure 1:
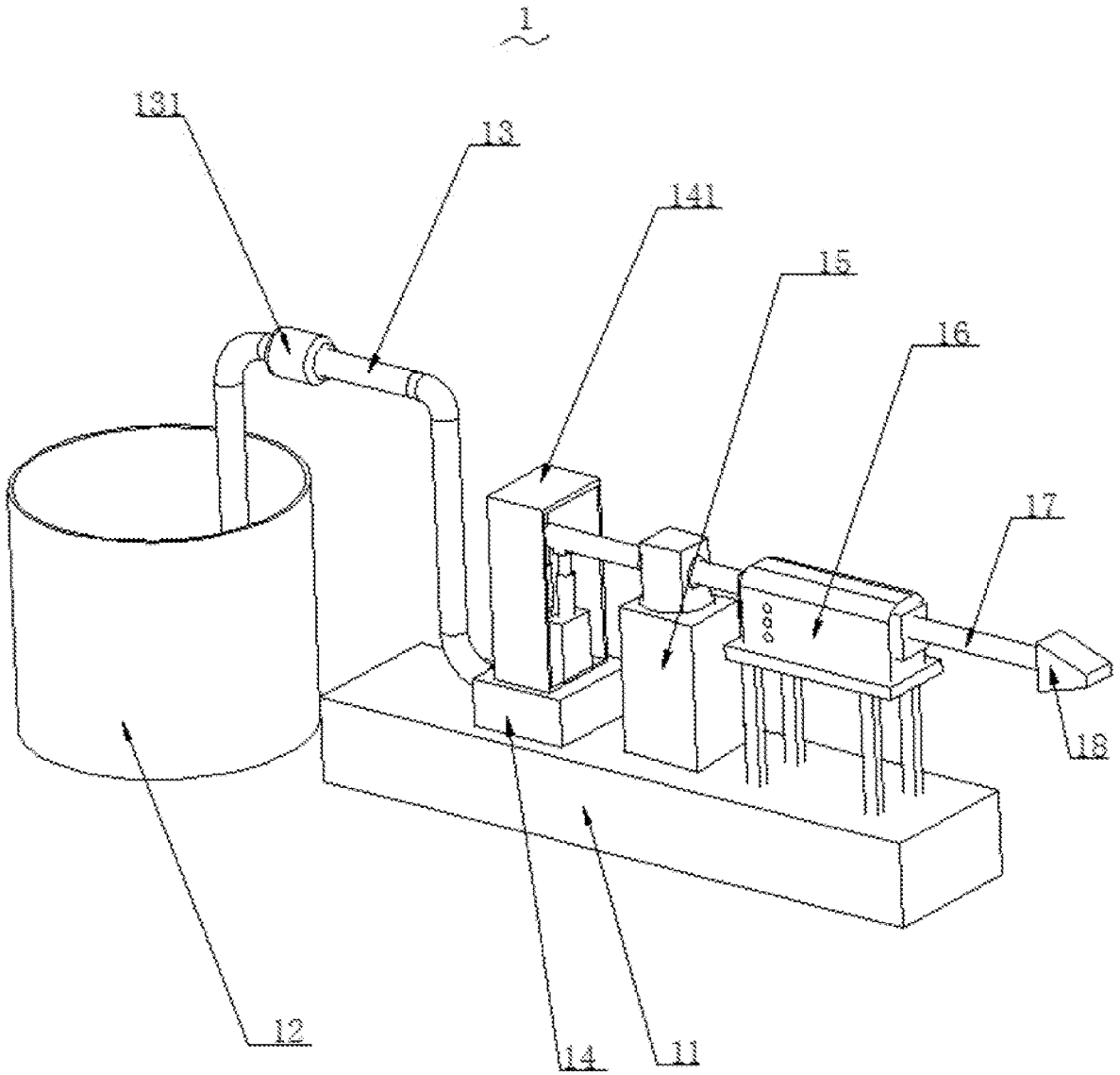
FIG. 1 is a perspective view showing a structure diagram of a water conserving reaming system of the present disclosure.
Figure 2:
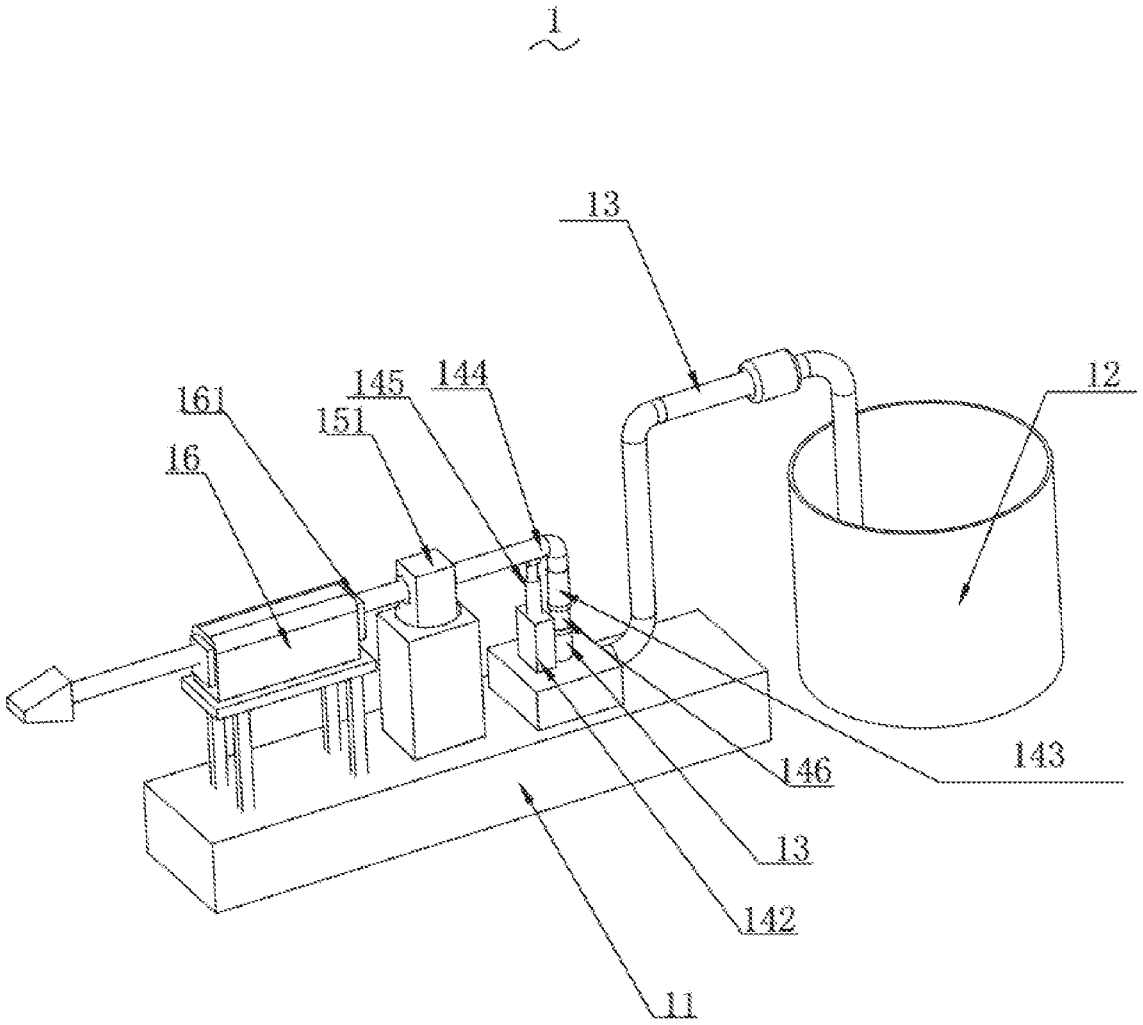
FIG. 2 is another perspective view showing a structure diagram of the water conserving reaming system of the present disclosure.
Figure 3:
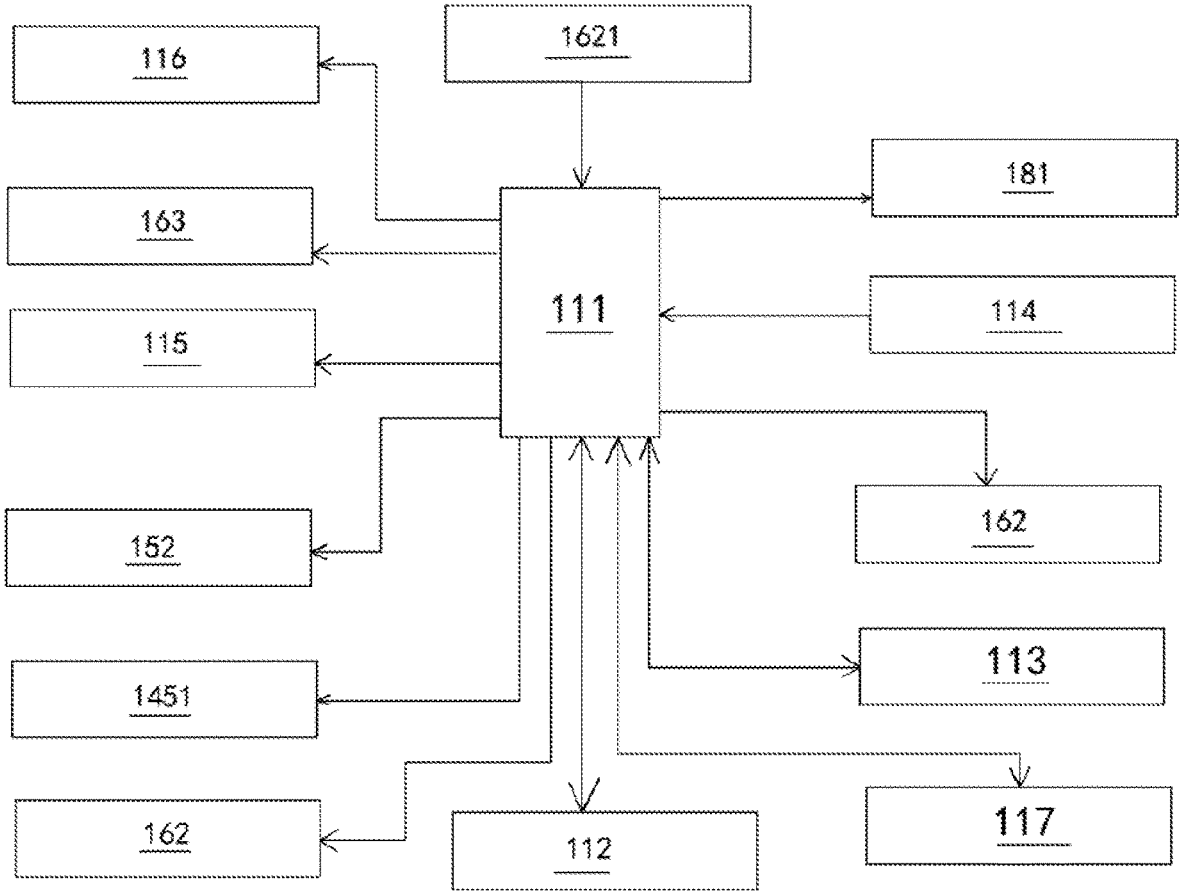
FIG. 3 is a circuit diagram of the water conserving reaming system of the present disclosure.

As shown in FIG. 1 and FIG. 2, the present disclosure of a water conserving reaming system 1 with high-sealing and high-abrasion resistance comprises a water storage box 12, a water pumping pipe 13 communicated with the water storage box 12, a first lifting, platform 14, a second lifting platform 15, reaming mechanism assembly 16, and a reamer bit 17 connected with a front end of the reaming mechanism assembly 16.

The first lifting platform 14 comprises a first base 142, a lifting frame 145 arranged on an upper portion of the first base 142, and a pipeline joint 146. An end of the water pumping pipe 13 extends into the water storage box 12, and an other end of the water pumping pipe 13 is communicated with a bottom portion of the first base 14. A filtering mechanism for performing primary filtering treatment on a water source from the water pumping pipe 13 is arranged inside the first base 142 of the first lifting platform 14. The second lifting platform 15 comprises a second base and a telescopic column 151 arranged on an upper portion of the second base. A first driving motor 152 configured to drive the telescopic column to move up and down is arranged inside the second base. The lifting frame 145 comprises a stand column and a driving air cylinder 1451 arranged on an upper portion of the stand column. The reaming mechanism assembly 16 comprises a supporting frame and a reaming main body 162 arranged on an upper portion of the supporting frame.

The water conserving reaming system 1 further comprises a water flow pipeline 144 made of hard materials. The water flow pipeline 144 is respectively connected with the first lifting platform 14, the second lifting platform 15, and the reaming mechanism assembly 16. A top end of the driving air cylinder 1451 of the lifting frame 145 abuts against the water flow pipeline 144, and the water flow pipeline 144 is L-shaped bent at the lifting frame 145. A telescopic flexible pipe 143 is arranged between the water flow pipeline 144 and the pipeline joint 146. The water flow pipeline 144 is connected with the pipeline joint 146 through the telescopic flexible pipe 143. A middle portion of the telescopic column 151 of the second lifting platform 15 defining a through hole configured to penetrate the water flow pipeline 144. The water flow pipeline 144 penetrates through the through hole and the through hole limits a movement of the water flow pipeline 144. The first driving motor 152 drives the telescopic column 151 to move up and down. The driving air cylinder 1451 directly drives the water flow pipeline 144 to move up and down parallel to and synchronous with the telescopic column.

The water conserving reaming system 1 further comprises a controller 111, a wireless communication unit 112, and a BLUETOOTH unit 117. The first driving motor 152, the driving air 1451, and the reaming main body 162 are electrically connected with the controller 111. A fixing base 11 for supporting the first lifting platform 14, the second lifting platform 15, and the reaming mechanism assembly 16 is arranged at bottom portions of the first lifting platform 14, the second lifting platform 15, and the reaming mechanism assembly 16. A sliding block 161 communicated with the water flow pipeline is arranged on a side of the reaming mechanism assembly 16 towards the second lifting platform 15. A second driving motor 162 is arranged inside the reaming mechanism assembly 16 and the second driving motor 162 drives the sliding block 161 to move up and down along with the water flow pipeline 144. The second driving motor 162 is electrically connected with the controller 111. A water pump is connected to the water pumping pipe 13 to extract the water source in the water storage box 12. The water pumping pipe 13 ranges from 15-25 cm in diameter. The water flow pipeline 144 ranges from 12-17 cm in diameter. A triangular shaped diamond 18 is connected to a front end portion of the reamer bit 17. And the diamond 18 defining a water spraying hole. The controller 111, the wireless communication unit 112, and the BLUETOOTH unit 117 are arranged inside the fixing base 11. And a touch display screen 113, a plurality of control buttons 114, and a plurality of signal indicating lights 115 are also arranged on a front surface of the fixing base 11. The touch display screen, the control buttons 114 and the signal indicating lights 115 are electrically connected with the controller 111. A height adjustment mechanism 163 is arranged on the supporting frame of the reaming mechanism assembly 16 to flexibly adjust a height of the reaming main body 162. The height adjustment mechanism 162 is electrically connected with the controller 111.

The present disclosure of the water conserving reaming system 1 comprises the water storage box 12, the water pumping pipe 13 communicated with the water storage box 12, the first lifting platform 14, the second lifting platform 15, the reaming mechanism assembly 16, and the reamer bit 17 connected with the front end of the reaming mechanism assembly 16. The first lifting platform 14 comprises the first base 142, the lifting frame 145 arranged on the upper portion of the first base 142, and the pipeline joint 146. The reaming mechanism assembly 16 is configured to perform the reaming operation, and the first lifting platform 14 and the second lifting platform 15 are capable of flexibly adjusting height, thereby achieving a good use effect. The water conserving reaming system 1 of the present disclosure is highly intelligent and convenient to use.

Furthermore, a high-definition infrared camera 181 is arranged on the diamond 18 of the reamer bit 17; and the high-definition infrared camera 181 is electrically connected with the controller 111.

Furthermore, the touch display screen 113 is a capacitive touch display screen.

Furthermore, an alerter 116 is arranged inside the fixing base 11. And a temperature sensor 1621 is arranged inside the reaming main body 162 of the reaming mechanism assembly 16. The alerter 116 and the temperature sensor 1621 are electrically connected with the controller 111.

Furthermore, a running indicating light is arranged on an outer side of the reaming main body 162.

Compared with the prior art, the present disclosure of the water conserving reaming system 1 comprises the water storage box 12, the water pumping pipe 13 communicated with the water storage box 12, the first lifting platform 14, the second lifting platform 15, the reaming mechanism assembly 16, and the reamer bit 17 connected with the front end of the reaming mechanism assembly 16. The first lifting platform 14 comprises the first base 142, the lifting frame 145 arranged on the upper portion of the first base 142 and the pipeline joint 146. The reaming mechanism assembly 16 is configured to perform the reaming operation, and the first lifting platform 14 and the second lifting platform 15 are capable of flexibly adjusting height, thereby achieving a good use effect, and the water conserving reaming system 1 of the present disclosure is highly intelligent and convenient to use.

The above-described embodiments of the present disclosure are not to be construed as limiting the scope of the present disclosure. Any of the modifications, equivalent replacement, and improvement within the spirit and principle of the present disclosure should fall within the protection scope of the claims.

What is claimed is:

1. A water conserving reaming system, comprising:

a water storage box;

a water pumping pipe communicated with the water storage box;

a first lifting platform;

a second lifting platform;

a reaming mechanism assembly; and a reamer bit connected with a front end of the reaming mechanism assembly;

wherein the first lifting platform comprises a first base, a lifting frame arranged on an upper portion of the first base, and a pipeline joint; an end of the water pumping pipe extends into the water storage box, and an other end of the water pumping pipe is communicated with a bottom portion of the first base; a filtering mechanism for performing primary filtering treatment on a water source from the water pumping pipe is arranged inside the first base of the first lifting platform; the second lifting platform comprises a second base and a telescopic column arranged on an upper portion of the second base; a first driving motor configured to drive the telescopic column to move up and down is arranged inside the second base; the lifting frame comprises a stand column and a driving air cylinder arranged on an upper portion of the stand column; the reaming mechanism assembly comprises a supporting frame and a reaming main body arranged on an upper portion of the supporting frame;

wherein the water conserving reaming system further comprises a water flow pipeline made of hard materials; the water flow pipeline is respectively connected with the first lifting platform, the second lifting platform, and the reaming mechanism assembly; a top end of the driving air cylinder of the lifting frame abuts against the water flow pipeline, and the water flow pipeline is L-shaped bent at the lifting frame; a telescopic flexible pipe is arranged between the water flow pipeline and the pipeline joint; the water flow pipeline is connected with the pipeline joint through the telescopic flexible pipe; a middle portion of the telescopic column of the second lifting platform defining a through hole configured to penetrate the water flow pipeline; the water flow pipeline penetrates through the through hole, and the through hole limits a movement of the water flow pipeline; the first driving motor drives the telescopic column to move up and down; the driving air cylinder directly drives the water flow pipeline to move up and down parallel to and synchronous with the telescopic column;

wherein the water conserving reaming system further comprises a controller, a wireless communication unit, and a BLUETOOTH unit; the first driving motor, the driving air cylinder, and the reaming main body are electrically connected with the controller; a fixing base for supporting the first lifting platform, the second lifting platform, and the reaming mechanism assembly is arranged at bottom portions of the first lifting platform, the second lifting platform, and the reaming mechanism assembly; a sliding block communicated with the water flow pipeline is arranged on a side of the reaming mechanism assembly towards the second lifting platform; a second driving motor is arranged inside the reaming mechanism assembly and the second driving motor drives the sliding block to move up and down along with the water flow pipeline; the second driving motor is electrically connected with the controller; a water pump is connected to the water pumping pipe to extract the water source in the water storage box; the water pumping pipe ranges from 15-25 cm in diameter; the water flow pipeline ranges from 12-17 cm in diameter; a triangular shaped diamond is connected to a front end portion of the reamer bit, and the diamond defining a water spraying hole; the controller, the wireless communication unit and the BLUETOOTH unit are arranged inside the fixing base; and a touch display screen, a plurality of control buttons and a plurality of signal indicating lights are also arranged on a front surface of the fixing base; the touch display screen, the control buttons, and the signal indicating lights are electrically connected with the controller; a height adjustment mechanism is arranged on the supporting frame of the reaming mechanism assembly to flexibly adjust a height of the reaming main body, the height adjustment mechanism is electrically connected with the controller.

2. The water conserving reaming system according to claim 1, wherein a high-definition infrared camera is arranged on the diamond of the reamer bit; and the high-definition infrared camera is electrically connected with the controller.

3. The water conserving reaming system according to claim 1, wherein the touch display screen is a capacitive touch display screen.

4. The water conserving reaming system according to claim 1, wherein an alerter is arranged inside the fixing base, and a temperature sensor is arranged inside the reaming main body; the alerter and the temperature sensor are electrically connected with the controller.

5. The water conserving reaming system according to claim 1, wherein a running indicating light is arranged on an outer side of the reaming main body.

* * * * *